US007390954B2

(12) United States Patent
Mizuno

(10) Patent No.: US 7,390,954 B2
(45) Date of Patent: Jun. 24, 2008

(54) ELECTRONIC MUSICAL APPARATUS SYSTEM, SERVER-SIDE ELECTRONIC MUSICAL APPARATUS AND CLIENT-SIDE ELECTRONIC MUSICAL APPARATUS

(75) Inventor: Shigehiko Mizuno, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 292 days.

(21) Appl. No.: 11/254,603

(22) Filed: Oct. 19, 2005

(65) Prior Publication Data

US 2006/0086235 A1 Apr. 27, 2006

(30) Foreign Application Priority Data

Oct. 21, 2004 (JP) ..... 2004-306395

(51) Int. Cl.
*G10H 7/00* (2006.01)

(52) U.S. Cl. ..... 84/609; 84/601; 84/622; 84/645

(58) Field of Classification Search ..... 84/609, 84/601, 622, 645
See application file for complete search history.

(56) References Cited

U.S. PATENT DOCUMENTS

| | | | | |
|---|---|---|---|---|
| 4,926,737 | A * | 5/1990 | Minamitaka | 84/611 |
| 5,389,729 | A * | 2/1995 | Hiramatsu | 84/601 |
| 5,734,119 | A * | 3/1998 | France et al. | 84/622 |
| 5,736,663 | A * | 4/1998 | Aoki et al. | 84/609 |
| 5,744,740 | A * | 4/1998 | Mizuno | 84/615 |
| 5,763,802 | A * | 6/1998 | Aoki et al. | 84/613 |
| 5,773,741 | A * | 6/1998 | Eller et al. | 84/609 |

(Continued)

FOREIGN PATENT DOCUMENTS

EP 1 501 072 A1 1/2005

(Continued)

OTHER PUBLICATIONS

WAP Forum, Wireless Application Protocol WAP 2.0 Technical White Paper, Wireless Application Protocol Forum Ltd., Jan. 2002, pp. 1-13.*

(Continued)

*Primary Examiner*—Lincoln Donovan
*Assistant Examiner*—Christina Russell
(74) *Attorney, Agent, or Firm*—Morrison & Foerster LLP

(57) ABSTRACT

A plurality of client-side electronic musical apparatuses 10 are connected to a server-side electronic musical apparatus 30 through a communications network 50. Each of the client-side electronic musical apparatuses 10, which is provided with an ID, attaches the ID to a signal representative of operation of performance operators 11 and setting operators 12, and transmits the ID-added signal to the server-side electronic musical apparatus 30. The server-side electronic musical apparatus 30 independently and concurrently executes, through the use of the ID, processes corresponding to the operational signals for the respective client-side electronic musical apparatuses 10 to generate musical tone data and display data, and transmits the generated data with the ID to the respective client-side electronic musical apparatuses 10. The thus-transmitted data is appropriately received by the client-side electronic musical apparatus 10 identified on the basis of the ID. In spite of having a simple configuration, therefore, the respective client-side electronic musical apparatuses 10 are able to independently and concurrently operate as a sophisticated and high-performance electronic musical apparatus.

13 Claims, 5 Drawing Sheets

U.S. PATENT DOCUMENTS

| | | | | |
|---|---|---|---|---|
| 5,886,274 | A * | 3/1999 | Jungleib | 84/601 |
| 5,929,359 | A * | 7/1999 | Sone et al. | 84/610 |
| 5,952,599 | A * | 9/1999 | Dolby et al. | 84/649 |
| 6,009,457 | A * | 12/1999 | Moller | 709/203 |
| 6,062,868 | A * | 5/2000 | Toriumi | 434/307 A |
| 6,072,113 | A * | 6/2000 | Tohgi et al. | 84/470 R |
| 6,143,973 | A * | 11/2000 | Kikuchi | 84/645 |
| 6,184,454 | B1 * | 2/2001 | Imai et al. | 84/622 |
| 6,211,453 | B1 * | 4/2001 | Kurakake | 84/609 |
| 6,267,600 | B1 * | 7/2001 | Song | 434/307 A |
| 6,308,222 | B1 * | 10/2001 | Krueger et al. | 709/247 |
| 6,331,669 | B1 * | 12/2001 | Lee et al. | 84/609 |
| 6,353,174 | B1 * | 3/2002 | Schmidt et al. | 84/609 |
| 6,441,291 | B2 * | 8/2002 | Hasegawa et al. | 84/609 |
| 6,570,080 | B1 * | 5/2003 | Hasegawa et al. | 84/609 |
| 6,703,549 | B1 * | 3/2004 | Nishimoto et al. | 84/609 |
| 6,898,729 | B2 * | 5/2005 | Virolainen et al. | 714/4 |
| 6,949,704 | B2 * | 9/2005 | Funaki | 84/609 |
| 6,953,887 | B2 * | 10/2005 | Nagashima et al. | 84/645 |
| 7,092,999 | B2 * | 8/2006 | Levitan | 709/218 |
| 7,183,481 | B2 * | 2/2007 | Hales | 84/645 |
| 7,223,912 | B2 * | 5/2007 | Nishimoto et al. | 84/609 |
| 7,268,287 | B2 * | 9/2007 | Kawashima | 84/600 |
| 2001/0037721 | A1 * | 11/2001 | Hasegawa et al. | 84/609 |
| 2002/0000156 | A1 * | 1/2002 | Nishimoto et al. | 84/609 |
| 2003/0000369 | A1 * | 1/2003 | Funaki | 84/609 |
| 2003/0076963 | A1 * | 4/2003 | Wells | 381/1 |
| 2003/0094090 | A1 * | 5/2003 | Tamura et al. | 84/602 |
| 2003/0156600 | A1 * | 8/2003 | Tsunoda et al. | 370/474 |
| 2003/0229681 | A1 * | 12/2003 | Levitan | 709/218 |
| 2004/0123727 | A1 * | 7/2004 | Hales | 84/645 |
| 2004/0221708 | A1 * | 11/2004 | Hasegawa | 84/601 |
| 2005/0235809 | A1 * | 10/2005 | Kageyama | 84/601 |

FOREIGN PATENT DOCUMENTS

| | | | |
|---|---|---|---|
| GB | 2 395 631 | | 5/2004 |
| JP | 3383108 | | 12/2002 |
| WO | WO 01/86628 | A2 * | 11/2001 |
| WO | WO-01/86628 | A2 | 11/2001 |
| WO | WO-03/081572 | | 10/2003 |

OTHER PUBLICATIONS

Alvaro Barbosa et al., "Public Sound Objects: A Shared Musical Space on the Web", Computer Society, Proceedings of the Second International Conference on WEB Delivering of Music, 2002.

WAP Forum, Wireless Application Protocol WAP 2.0 Technical White Paper, Wireless Application Protocol Forum Ltd., Jan. 2002, pp. 1-13.

* cited by examiner

ELECTRONIC MUSICAL APPARATUS SYSTEM, SERVER-SIDE ELECTRONIC MUSICAL APPARATUS AND CLIENT-SIDE ELECTRONIC MUSICAL APPARATUS

BACKGROUND OF THE INVENTION

1. Field of the Invention

The present invention relates to an electronic musical apparatus system in which a plurality of client-side electronic musical apparatuses are connected to a server-side electronic musical apparatus via a communications network, the server-side electronic musical apparatus and the client-side electronic musical apparatuses which compose the system, and computer programs applied to the apparatuses.

2. Description of the Related Art

There have been a wide variety of electronic musical apparatuses such as electronic musical instruments, ranging from sophisticated and high-performance apparatuses (hereinafter referred to as high-grade apparatuses) to unsophisticated and low-performance apparatuses (hereinafter referred to as low-grade apparatuses). In addition, there has been a conventional scheme in which a low-grade apparatus is connected with a high-grade apparatus through MIDI, for example, to allow the low-grade apparatus to perform functions of the high-grade apparatus and to synchronize sequencers of the low-grade apparatus and the high-grade apparatus (see JP3383108B, for example).

In the above conventional scheme, however, those apparatuses cannot be operated independently and concurrently. In order to allow a plurality of electronic musical apparatuses to concurrently perform sophisticated and high-performance tasks, therefore, the respective electronic musical apparatuses have to be sophisticated and high-performance.

SUMMARY OF THE INVENTION

The present invention was accomplished to solve the above-described problem, and an object thereof is to provide an electronic musical apparatus system which enables each of a plurality of electronic musical apparatuses to independently and concurrently perform sophisticated and high-performance tasks in spite of their simple configuration. In addition, the object of the present invention is also to provide a server-side electronic musical apparatus and client-side electronic musical apparatuses that form the system, and computer programs applied to the apparatuses.

In order to achieve the above-described object, it is an aspect of the present invention to provide an electronic musical apparatus system in which a plurality of client-side electronic musical apparatuses are connected to a server-side electronic musical apparatus through a communications network, wherein each of the plurality of client-side electronic musical apparatuses is provided with identification data for identifying the respective client-side electronic musical apparatuses, and the each of the plurality of client-side electronic musical apparatuses comprises an operational signal transmitting portion for attaching the provided identification data to an operational signal representative of operation by a user on the client-side electronic musical apparatus, and transmitting the operational signal with the identification data to the server-side electronic musical apparatus; a data reproducing portion for retrieving, from among musical tone data or display data having identification data transmitted from the server-side electronic musical apparatus in response to the transmission of operational signal, musical tone data or display data having its own identification data, and generating a musical tone signal or displaying a screen on the basis of the retrieved musical tone data or display data, and wherein the server-side electronic musical apparatus comprises a data generating portion for receiving operational signals transmitted from the respective client-side electronic musical apparatuses, and independently and concurrently executing, through the use of identification data attached to the operational signals, processes corresponding to the operational signals for the respective client-side electronic musical apparatuses to generate musical tone data or display data; and a data transmitting portion for attaching to the musical tone data or display data generated by the data generating portion the identification data attached to the operational signals and transmitting the musical data or display data with the identification data to the respective client-side electronic musical apparatuses.

It is another aspect of the present invention to provide a server-side electronic musical apparatus connected with a plurality of client-side electronic musical apparatuses through a communications network, the server-side electronic musical apparatus comprising a data generating portion for receiving operational signals which are transmitted from the respective client-side electronic musical apparatuses and to which identification data for identifying the respective client-side electronic musical apparatuses are attached, and independently and concurrently executing, through the use of the identification data attached to the operational signals, processes corresponding to the operational signals for the respective client-side electronic musical apparatuses to generate musical tone data or display data; and a data transmitting portion for attaching to the musical tone data or display data generated by the data generating portion the identification data attached to the operational signals and transmitting the musical data or display data with the identification data to the respective client-side electronic musical apparatuses.

It is a further aspect of the present invention to provide a client-side electronic musical apparatus connected with a server-side electronic musical apparatus through a communications network, the client-side electronic musical apparatus comprising an operational signal transmitting portion for attaching identification data for identifying the client-side electronic musical apparatus to an operational signal representative of operation by a user on the client-side electronic musical apparatus, and transmitting the operational signal with the identification data to the server-side electronic musical apparatus; and a data reproducing portion for retrieving, from among musical tone data or display data having identification data transmitted from the server-side electronic musical apparatus in response to the transmission of operational signal, musical tone data or display data having its own identification data, and generating a musical tone signal or displaying a screen on the basis of the retrieved musical tone data or display data.

The respective client-side electronic musical apparatuses in the present invention have, for example, a performance operator for use in performance of a musical instrument, an operator for selecting or controlling the mode of musical tones to be generated, an operator for selecting or controlling the mode of a display unit, a sound system formed of an amplifier and speakers for generating musical tones, a display unit for displaying a screen and the like. The client-side electronic musical apparatuses, however, are not provided with a tone generator, sequencer, mixer, recorder and the like, or are provided with a tone generator, sequencer, mixer, recorder and the like that have only simple functions. Operational signals transmitted from the client-side electronic musical apparatuses to the server-side electronic musical apparatus are the signals indicative of, for example, performance operational event representative of operation of the performance operators, operational event representative of operation of the operators for selecting or controlling the mode of musical tones to be generated or the mode of the display unit, and the like. The server-side electronic musical apparatus is provided with devices that achieve various musical functions such as a tone generator, sequencer, mixer, and recorder.

In the present invention configured as described above, transmission of operational signals with identification data from the respective client-side electronic musical apparatuses to the server-side electronic musical apparatus causes the server-side electronic musical apparatus to independently and concurrently execute processes corresponding to the operational signals for the client-side electronic musical apparatuses and transmit resultant musical tone data or display data with the identification data to the respective client-side electronic musical apparatuses. Each of the client-side electronic musical apparatuses then retrieves musical tone data or display data having its own identification data to generate a musical tone signal or display a screen. As a result, the client-side electronic musical apparatuses, in spite of being unsophisticated and low-performance, can utilize the sophisticated and high-performance functions of the server-side electronic musical apparatus, substantially operating as a sophisticated and high-performance electronic musical apparatus. Particularly, since the server-side electronic musical apparatus performs various processing independently and concurrently in response to requests from the plurality of client-side electronic musical apparatuses, the present invention is convenient in that the plurality of client-side electronic musical apparatuses are available independently and concurrently.

Furthermore, the present invention can be configured and embodied not only as an invention of an apparatus but also as an invention of a computer program and a method.

DESCRIPTION OF THE PREFERRED EMBODIMENT

Figure 1:
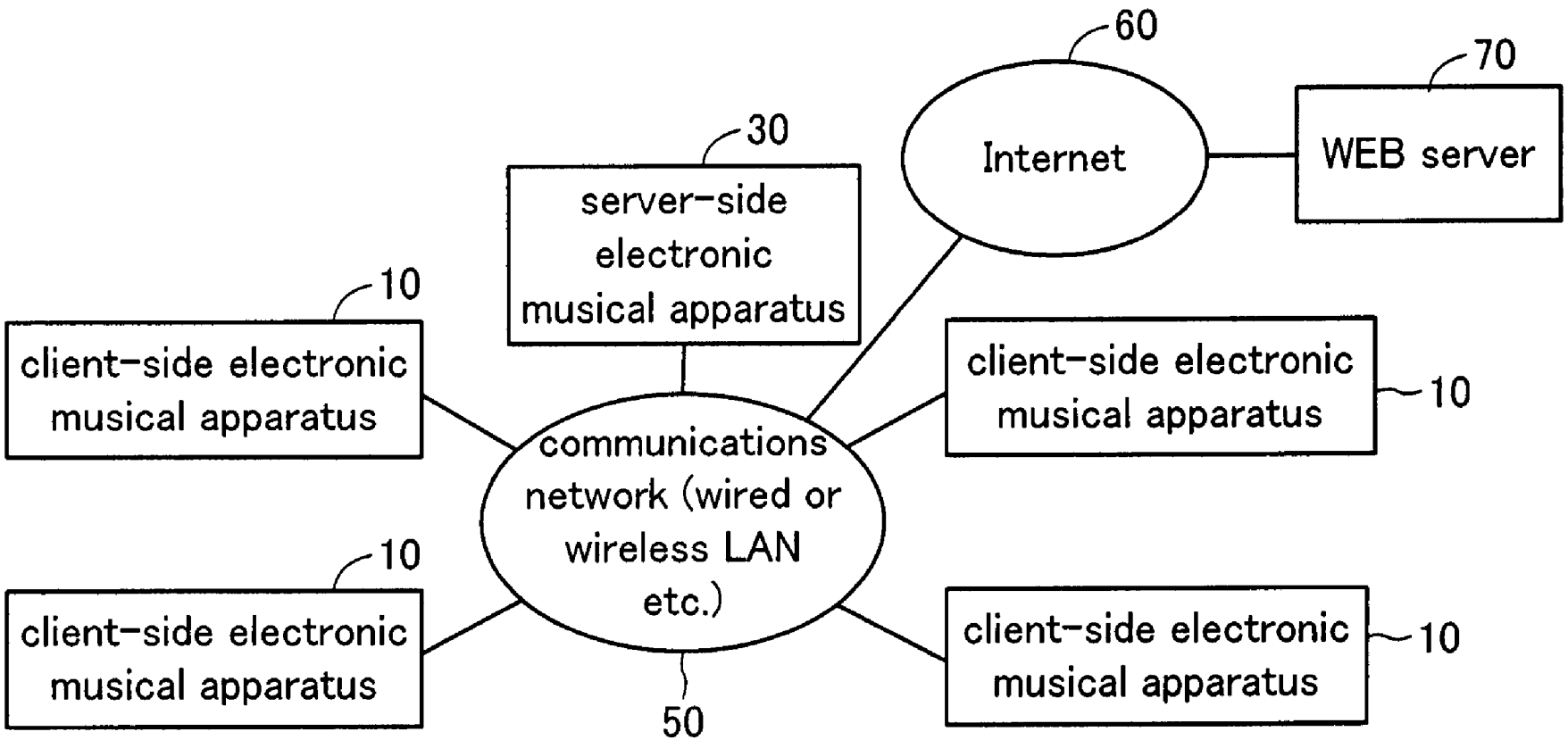
FIG. 1 is a schematic diagram showing the general arrangement of an electronic musical apparatus system according to an embodiment of the present invention.

An embodiment of the present invention will now be described with reference to the drawings. FIG. 1 shows a block diagram showing an electronic musical apparatus system of the present invention. The electronic musical apparatus system includes a plurality of client-side electronic musical apparatuses 10 (four client-side electronic musical apparatuses 10 in the present embodiment) and a server-side electronic musical apparatus 30. The client-side electronic musical apparatuses 10 and the server-side electronic musical apparatus 30 are located in a relatively confined area such as a music room, a music rehearsal room or a building, interconnecting via a communications network 50 such as a wired or wireless local network. The communications network 50 is also connected to the Internet 60 to allow the server-side electronic musical apparatus 30 and the client-side electronic musical apparatuses 10 to download various programs and data from a WEB server 70 via the Internet 60.

Figure 2:
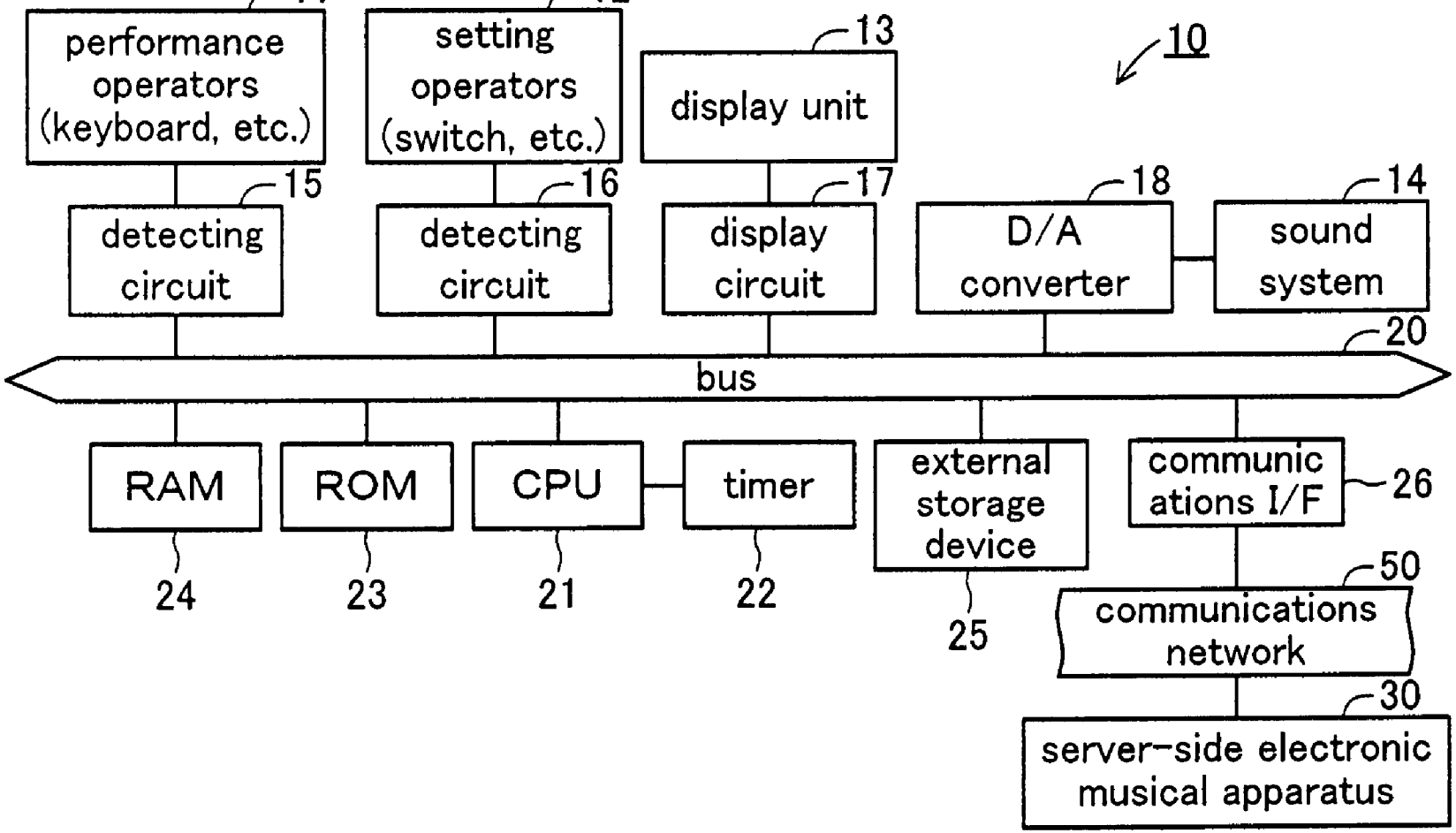
FIG. 2 is a hardware block diagram of client-side electronic musical apparatuses shown in FIG. 1.

The client-side electronic musical apparatuses 10 are simple electronic musical apparatuses which basically do not have a tone generator, sequencer, mixer, recorder or the like. Each of the client-side electronic musical apparatuses 10 is provided with unique identification data (hereinafter simply referred to as ID). Used as the ID may be electronic musical apparatus ID for discerning between apparatuses or IP address for discerning between network addresses. As shown in FIG. 2, each of the client-side electronic musical apparatus 10 has performance operators 11, setting operators 12, a display unit 13 and a sound system 14.

The performance operators 11 are used for playing a musical instrument, composed of operational elements of a keyboard type, a stringed instrument type, a percussion instrument type, a wind instrument type or the like. The setting operators 12, which are provided on an operating panel, are used for specifying the mode (pitch, loudness, tone color, type of accompaniment, musical piece, etc.) of musical tones to be generated, the display mode of the display unit 13, and the like. The setting operators 12 include physical switches, sliders, knobs, etc. The setting operators 12 also include a mouse and software operational elements of touch panel type for inputting instructions related to the display mode of the display unit 13. The operation of the performance operators 11 and the setting operators 12 is detected by detecting circuits 15, 16 connected to a bus 20.

The display unit 13 is configured by a liquid crystal display, a CRT or the like, displaying characters, numerals, graphics, etc. The display mode of the display unit 13 is controlled by a display circuit 17 that is connected to the bus 20. The sound system 14 includes speakers, amplifiers, and the like and emits tones represented by analog musical tone signals supplied from a D/A converter 18. The D/A converter 18, which is connected to the bus 20, converts digital musical tone signals (digital audio data representative of the instantaneous value of a musical tone signal) supplied through the bus 20 into analog signals and outputs the converted signals to the sound system 14.

Figure 4:
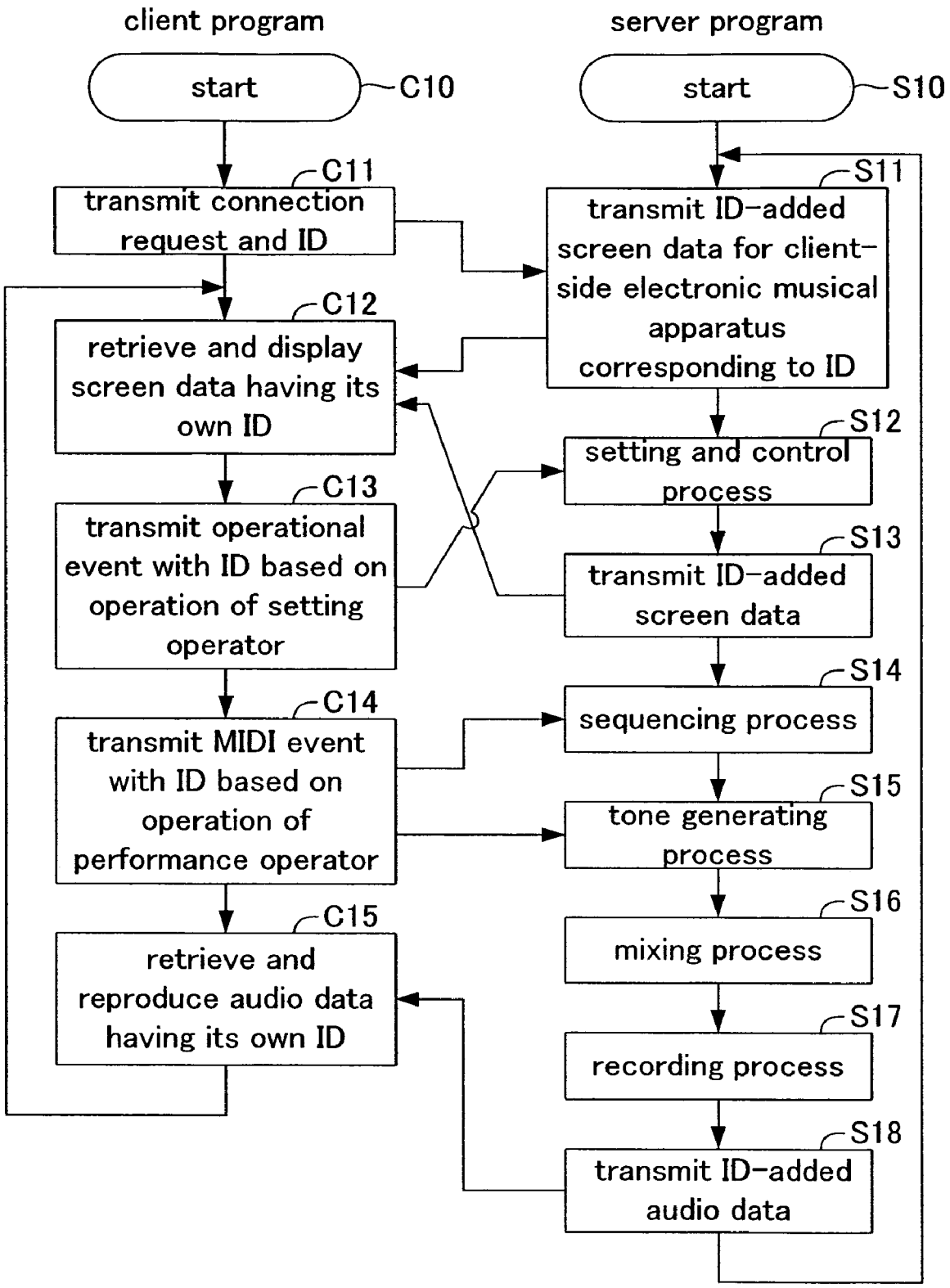
FIG. 4 is a flowchart showing a client program and a server program.

Furthermore, the client-side electronic musical apparatus 10 also has a CPU 21, a timer 22, a ROM 23 and a RAM 24 that are connected to the bus 20 and compose the main body of a microcomputer. The client-side electronic musical apparatus 10 also includes an external storage device 25 and a communications interface circuit 26 that are connected to the bus 20. The external storage device 25 includes various storage media such as HD, CD, FD, MO, DVD, and semiconductor memory that are previously incorporated in or are attachable to the client-side electronic musical apparatus 10. The external storage device 25 also includes drive units for the storage media to enable storing and reading of voluminous data and programs. The data and programs are previously stored in the external storage device 25 before incorporation into the client-side electronic musical apparatus 10, are stored in the external storage device 25 that is arbitrarily attached to the client-side electronic musical apparatus 10, or are externally supplied through the communications interface circuit 26 to the external storage device 25. In the present embodiment, particularly, in the external storage device 25 there are stored the above-described IDs and a client program shown in FIG. 4. The communications interface circuit 26 is connected to the communications network 50.

Figure 3:
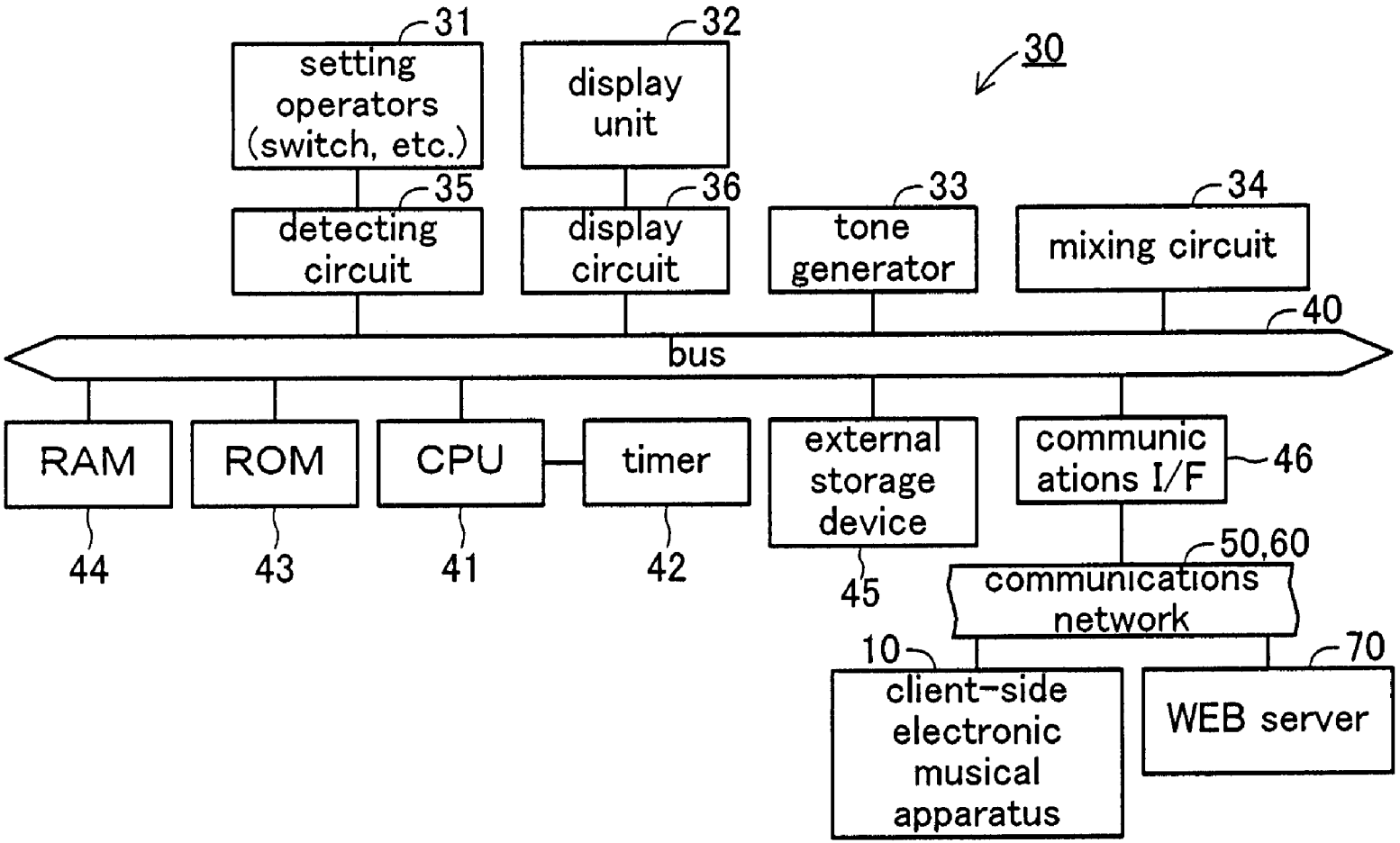
FIG. 3 is a hardware block diagram of a server-side electronic musical apparatus shown in FIG. 1.

The server-side electronic musical apparatus 30 includes, as shown in FIG. 3, setting operators 31, a display unit 32 and detecting circuits 35, 36 that are similar to the setting operators 12, the display unit 13, and the detecting circuits 15, 16 of the client-side electronic musical apparatus 10. The server-side electronic musical apparatus 30 also includes a tone generator 33 and a mixing circuit 34. The tone generator 33, which is connected to a bus 40, inputs MIDI event data (tone generation control data, musical tone control data, etc.) supplied under the later-described control of CPU 41, generates digital musical tone signals on the basis of the MIDI event data, and outputs the generated signals. The tone generator 33 has a multiplicity of tone generator channels in order to generate musical tone signals requested from the plurality of client-side electronic musical apparatuses 10. The tone generator 33 is provided with 256 tone generator channels, for example, to allow each of the four client-side electronic musical apparatuses 10 to simultaneously generate 64 tone signals on average on the basis of requests from the four client-side electronic musical apparatuses 10. The mixing circuit 34 appropriately mixes digital musical tone signals generated for respective client-side electronic musical apparatuses 10 at the tone generator 33 and outputs the mixed musical tone signals.

Furthermore, the server-side electronic musical apparatus 30 also has a CPU 41, a timer 42, a ROM 43 and a RAM 44 that are connected to the bus 40 and compose the main body of a microcomputer. The server-side electronic musical apparatus 30 also includes an external storage device 45 and a communications interface circuit 46 that are connected to the bus 40. The CPU 41, timer 42, ROM 43, RAM 44, external storage device 45 and communications interface circuit 46 are configured similarly to the CPU 21, timer 22, ROM 23, RAM 24, external storage device 25 and communications interface circuit 26 of the client-side electronic musical apparatus 10. In the external storage device 45, however, there is stored music data (automatic performance data), automatic accompaniment data and the like for use in a server program shown in FIG. 4 and a later-described sequencer module BL14 shown in FIG. 5.

Figure 5:
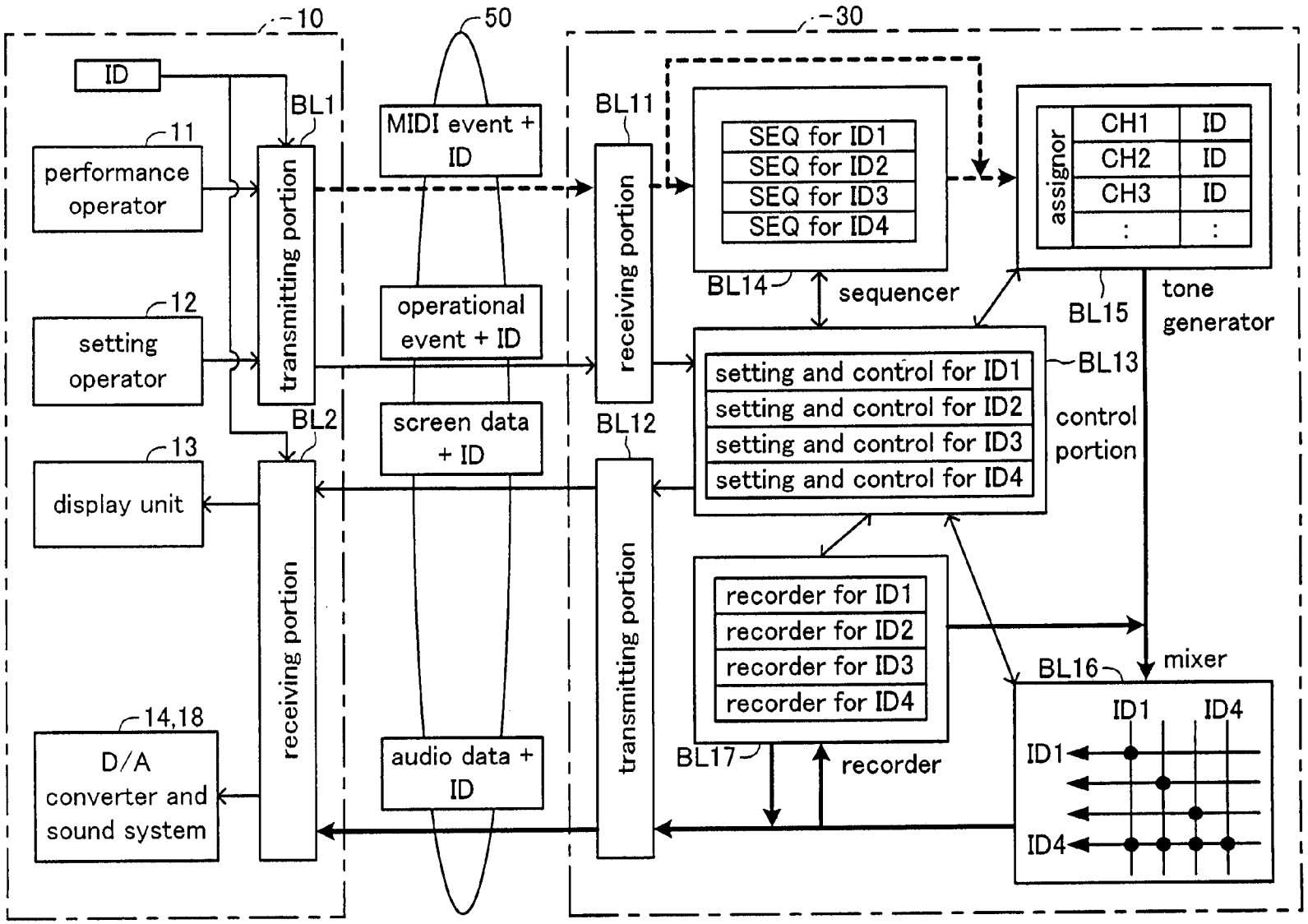
FIG. 5 is a functional block diagram of the client-side electronic musical apparatus and the server-side electronic musical apparatus.

Execution of the server program enables the CPU 41 to, through the use of the above-described music data, automatic accompaniment data and the like, achieve musical tone generating function, sequencer function, mixing function and recording function in cooperation with the tone generator 33 and the mixing circuit 34. These functions will be detailed in the descriptions about processes of the server program with reference to a functional block diagram of FIG. 5. A transmitting portion BL1 of the client-side electronic musical apparatus 10 in the functional block diagram in FIG. 5 corresponds to the communications interface circuit 26 in FIG. 2 and the process for transmitting various data and various instructions to the server-side electronic musical apparatus 30. A receiving portion BL2 corresponds to the communications interface circuit 26 in FIG. 2 and the process for receiving musical tone data and screen data from the server-side electronic musical apparatus 30. A receiving portion BL11 of the server-side electronic musical apparatus 30 in the functional block diagram of FIG. 5 corresponds to the communications interface circuit 46 in FIG. 3 and the process for receiving various data and various instructions from the client-side electronic musical apparatuses 10. A transmitting portion BL12 corresponds to the communications interface circuit 46 in FIG. 3 and the process for transmitting musical tone data and screen data to the client-side electronic musical apparatuses 10. In FIG. 5, furthermore, thick solid lines indicate traffic of digital musical tone signals (audio digital data) while thick broken lines indicate traffic of MIDI event data (performance event information). Thin solid lines indicate traffic of other signals (screen data and operational event data of the setting operator 12).

Next explained will be operation of the embodiment configured as described above. After power switch which is not shown is turned on, the client-side electronic musical apparatus 10 starts executing the client program of FIG. 4 at step C10. After performing step C11, the client-side electronic musical apparatus 10 repeatedly executes circulating processing formed of steps C12 to C15. The server-side electronic musical apparatus 30 starts executing the server program of FIG. 4 at step S10 and repeatedly executes circulating processing formed of steps S11 to S18.

At step C11, if an instruction to establish connection with the server-side electronic musical apparatus 30 is issued by a user through the manipulation of the setting operators 11 of the client-side electronic musical apparatus 10, the CPU 21 transmits a connection request and its own ID to the server-side electronic musical apparatus 30 via the communications network 50. At step C11, alternatively, after start-up of the client-side electronic musical apparatus 10, the CPU 21 automatically transmits a connection request and its own ID to the server-side electronic musical apparatus 30 via the communications network 50. By the process of step S11 the server-side electronic musical apparatus 30 transmits, onto the communications network 50, screen data for the client-side electronic musical apparatus 10 which corresponds to the above-transmitted ID. To the screen data there is attached the above-transmitted ID. By the process of step C12, one of the client-side electronic musical apparatuses 10 identified on the basis of the ID transmitted from the server-side electronic musical apparatus 30 retrieves the ID-added screed data and displays the data on the display unit 13. The screen data in this case is the data used for making instructions and settings of later-described various functions of the server-side electronic musical apparatus 30.

When settings on various functions have been made on the above-identified client-side electronic musical apparatus 10 through the operation of the setting operators 12 in accordance with the display screen of the display unit 13, the client-side electronic musical apparatus 10 transmits, at step C13, an operational event signal representative of the operation of the setting operators 12 to the server-side electronic musical apparatus 30 via the communications network 50, attaching the ID of its own to the operational event signal. At step S12 the server-side electronic musical apparatus 30 receives the above-transmitted operational event signal and conducts the setting process required for a sequencing process of step S14, a tone generating process of step S15, a mixing process of step S16, and a recording process of step S17.

After conducting the process of step S12, the CPU 41 generates, at step S13, screen data for displaying a screen which results from the operational event of the client-side electronic musical apparatus 10. The screen to be generated includes a screen of the respective functions (e.g., a screen regarding the sequencer) and a screen that is not limited to any of the above-described functions but is applicable to the functions in common (e.g., a screen for switching between functions). At step S13 the CPU 41 then transmits the generated screen data onto the communications network 50, accompanying the screen data with the ID that has been attached to the operational event signal. These processes of steps S12, S13 correspond to the function performed by a control portion BL13 in the functional block diagram of FIG. 5.

In the functional block diagram of FIG. 5, the sequencing process, tone generating process, mixing process and recording process are represented as a sequencer module BL14, a tone generator module BL15, a mixer module BL16 and a recorder module BL17, respectively. Therefore, the control portion BL 13 receives an operational event from the client-side electronic musical apparatus 10, issues, to the modules BL14 through BL17, a command corresponding to the operational event, and generates screen data for displaying a screen of the respective function modules (e.g., a screen regarding the sequencer) and a screen that is not limited to any of the above-described function modules but is applicable to the function modules in common (e.g., a screen for switching between functions), the screen resulting from the operational event. The control portion BL13 then transmits the generated screen data onto the communications network 50, accompanying the screen data with the ID that has been attached to the operational event signal.

By the above-described step C12, the client-side electronic musical apparatus 10 identified on the basis of the ID attached to the screen data retrieves the ID-added screen data transmitted onto the communications network 50, and displays on the display unit 13 a screen represented by the retrieved screen data. The processes of steps C12, C13 and steps S12, S13 enable the client-side electronic musical apparatus 10 to specify the behaviors of function modules BL14 through BL17 of the server-side electronic musical apparatus 30.

The transmission of screen data from the server-side electronic musical apparatus 30 to the client-side electronic musical apparatus 10 may be done such that a screenful of data representative of the whole content of one screen is sent at each transmission. Alternatively, the transmission may be done such that sent at each transmission is only partial data representative of a change to contents contained in a screen. In this case, the screenful data and the partial screen data may be distinguished on the basis of screen ID (screen identification data). In this scheme, the client-side electronic musical apparatus 10 receives only screen ID at first. If the client-side electronic musical apparatus 10 stores screen data corresponding to the received screen ID, the client-side electronic musical apparatus 10 reads out and displays the stored screen data. If the screen data is not stored, the client-side electronic musical apparatus 10 issues a request for the screen data to the server-side electronic musical apparatus 30. This scheme helps alleviate network traffic as well as increase imaging speed.

At the above-described step S12 (the control portion BL13) which controls the settings of the function modules BL14 through BL17, the CPU 41 processes instructions made by the plurality of client-side electronic musical apparatuses 10 independently in parallel. Therefore, even if the client-side electronic musical apparatuses 10 are not provided with sufficient screen data, the client-side electronic musical apparatuses 10 are able to appropriately establish settings of the function modules of the server-side electronic musical apparatus 30.

Next explained will be the sequencing process of step S14, i.e., the sequencer module BL14. The sequencer module BL14 is composed of a plurality of sequencer modules, each corresponding to each ID of the client-side electronic musical apparatuses 10. Each sequencer module operates independently; for example, the start and stop of each sequencer module are independently controlled by the corresponding client-side electronic musical apparatus 10. Furthermore, the tempo of the sequencer, the functions of the sequencer and the like may vary among the client-side electronic musical apparatuses 10. The functions of the sequencer modules include a music data storage/reproduction function, an automatic accompaniment function, an automatic composition function, a performance assistance function, a training function, a musical score display function, and the like.

In the music data storage function, if the performance operators 11 of the client-side electronic musical apparatus 10 is operated by a user, the CPU 21 transmits, by the process of step C14, an ID-attached operational event signal (MIDI event data) representative of the operation of the performance operators 11 to the server-side electronic musical apparatus 30 via the communications network 50. In the sequencer module BL14 there are stored, for each ID, operational events representative of operations of the performance operators 11. In the music data reproduction function, MIDI event data which forms music data is sequentially read out and supplied to the tone generator module BL 15.

In the automatic accompaniment function, MIDI event data representative of an operational event of the performance operators 11 transmitted from the client-side electronic musical apparatus 10 by the process similar to above-described step S14 is processed by use of automatic accompaniment data and supplied to the tone generator module BL15 as MIDI event data for controlling generation of accompaniment tones. In the automatic composition function, MIDI event data for controlling generation of a series of musical tones is automatically generated and supplied to the tone generator module BL15. In the performance assistance function, on the basis of MIDI event data representative of an operational event of the performance operators 11 supplied similarly to the above-described automatic accompaniment function, MIDI event data for assisting performance is automatically generated and supplied to the tone generator module BL15. In the case as well where MIDI event data is supplied from the sequencer module BL14 to the tone generator module BL15, an ID for identifying the client-side electronic musical apparatus 10 is attached to the MIDI event data.

In the training function, on the basis of stored music data, screen data representative of training material for the user is generated and transmitted onto the communications network 50. In the musical score display function, on the basis of stored music data, screen data representative of a musical score is generated and transmitted onto the communications network 50. In these training function and musical score display function as well, an ID for identifying the client-side electronic musical apparatus 10 is attached to the screen data. The ID-added screen data is then transmitted by the process of step S13, i.e., the control portion BL13. On the display unit 13 of the client-side electronic musical apparatus 10, as a result, there is displayed the training material or the musical score.

Next explained will be the tone generating process of step S15, i.e., the tone generator module BL15. The tone generator module BL15 generates, in cooperation with the tone generator 33 having a multiplicity of hardware tone generator channels, digital musical tone signals for respective client-side electronic musical apparatuses 10 and outputs the generated signals. Furthermore, the tone generator module BL15 has a channel assignment function achieved by the program process of step S5. The channel assignment function causes the tone generator module BL15 to receive ID-added MIDI event data (performance operational event signals by the performance operators 11) transmitted from the client-side electronic musical apparatus 10 at the above-described process C14, and assign the MIDI event data to one of the tone generator channels of the tone generator 33 in corresponding relation to the received ID. Alternatively, the assignment may be made such that a predetermined number of tone generator channels provided in the tone generator 33 are previously assigned to the respective client-side electronic musical apparatuses 10 so that the MIDI event data is assigned to any one of the predetermined number of tone generator channels designated by the received ID.

The tone generator channels to which MIDI event data is assigned then generate digital musical tone signals specified by the MIDI event data. As a result, the tone generating process of step S15, i.e., the tone generator module BL15 generates digital musical signals which follow parameters defined by the above-described step S12, i.e., the control portion BL13, allowing each of the client-side electronic musical apparatuses 10 to generate digital musical tone signals in an independent manner. The digital musical tone signals (i.e., digital audio data) generated as described above are then transmitted to an input bus provided in corresponding relation to an ID of the mixer module BL16.

Next explained will be a mixing process of step S16, i.e., the mixer module BL16. The mixer module BL16 is realized by a program process done by the CPU 41 in cooperation with the mixing circuit 34. The mixer module BL16 has sets of an input bus and an output bus, each corresponding to a different one of the client-side electronic musical apparatuses 10. The mixer module BL16 also has a plurality of mixing buses (not shown) provided between the respective input buses and the respective output buses so that a digital musical tone signal that is input to an input bus is selectively output to an output bus. A digital musical tone signal transmitted from the tone generator module BL15 to an input bus corresponding to the ID is basically output without being processed. As shown in depicted ID4, however, digital musical tone signals transmitted to a plurality of input buses may be mixed and output to one output bus. This achieves concerted music by the plurality of client-side electronic musical apparatuses 10. In a case where an instructor plays with his/her students, in addition, this also enables the instructor to obtain musical tones emitted by the plurality of client-side electronic musical apparatuses 10. The settings of the mixer module BL16 are also established by the process of the above-described step S12, i.e., the operation of the control portion BL13.

Next explained will be the recording process of step S17, i.e., the recorder module BL17. The recorder module BL17 records digital musical tone signals (digital audio data) output in the mixer module BL16 from the output buses each corresponding to the respective client-side electronic musical apparatuses 10 (i.e., the respective IDs) in a recorder (the external storage device 45) for each of the client-side electronic musical apparatuses 10. The recorder module BL17 also reproduces the digital musical tone signals (digital audio data) recorded in the recorder for the respective client-side electronic musical apparatuses 10. In this case, the digital musical tone signals may be output to the respective client-side electronic musical apparatuses 10 without being processed. Alternatively, the digital musical tone signals may be sent back to the mixer module BL17, mixed with other digital musical tone signals and output to the client-side electronic musical apparatuses 10. Settings of the recording/reproduction of digital musical tone signals are also established by the above-described step S12, i.e., the operation of the control portion BL13.

The digital musical tone signals (digital audio data) mixed by the mixer module BL16 and the digital musical tone signals (digital audio data) reproduced by the recorder module BL17 as described above are transmitted, by the process of step S18, onto the communications network 50. In this case, the server-side electronic musical apparatus 30 performs packet-processing on the digital musical tone signals, converting the signals into a corresponding ID-added audio packet and transmitting the packet onto the communications network 50.

The client-side electronic musical apparatus 10 identified by the ID attached to the audio packet retrieves, by the process of step C15, the audio packet transmitted onto the communications network 50 and outputs the retrieved packet to the D/A converter 18. Since the D/A converter 18 converts digital musical tone signals (digital audio data) contained in the audio packet into analog signals and supplies the converted signals to the sound system 14, emitted from the sound system 14 are musical tones corresponding to the digital musical tone signals.

As described above, similarly to the above-described process of step S12 (setting and control by the control portion BL13), on performing the sequencing process, tone generating process, mixing process and recording process of steps S14 to S17, i.e., on operating the sequencer module BL14, tone generator module BL15, mixer module BL16 and recorder module BL17, the CPU 41 performs processing on the respective client-side electronic musical apparatuses 10 independently in parallel. In other words, the CPU 41 performs processing on an ID basis. Even if the client-side electronic musical apparatuses 10 are not provided with plenty of various data for music and various music programs, therefore, the respective client-side electronic musical apparatuses 10 can concurrently reproduce satisfactory musical tones supplied from the server-side electronic musical apparatus 30. In addition, the functions of the above-described modules BL14 to BL17 may be enhanced by loading the latest function module program via the Internet 60 from the web server 70 or the attachable external storage device 25.

As apparent from the above operational descriptions, the above-described embodiment allows the respective client-side electronic musical apparatuses 10, in spite of being unsophisticated and low-performance, to utilize the sophisticated and high-performance functions of the server-side electronic musical apparatus 30 to operate as a sophisticated and high-performance electronic musical apparatus. Particularly, since the server-side electronic musical apparatus 30 performs various processing independently in parallel in response to requests from the plurality of client-side electronic musical apparatuses 10, the above-described embodiment is convenient in that the plurality of client-side electronic musical apparatuses 10 are available independently and concurrently.

In carrying out the present invention, furthermore, it will be understood that the present invention is not limited to the above-described embodiment, but various modifications may be made without departing from the spirit and scope of the invention.

In the above-described embodiment, for instance, each of the client-side electronic musical apparatuses 10 is provided with a different ID, however, the above embodiment may be modified such that the plurality of client-side electronic musical apparatuses 10 share one ID. The modified embodiment is useful, for example, in such a case as a user concurrently operates the plurality of the client-side electronic musical apparatuses 10 and share the sequencer module BL14 and the recorder module BL17 among the client-side electronic musical apparatuses 10. In addition, the modified embodiment is useful when an instructor and a student operate the client-side electronic musical apparatuses 10 independently but share the sequencer module BL14 and the recorder module BL17 among the client-side electronic musical apparatuses 10.

In the above-described embodiment, furthermore, the client-side electronic musical apparatuses 10 are allowed to use all the functions of the server-side electronic musical apparatus 30, however, the above-described embodiment may be modified such that the functions of the server-side electronic musical apparatus 30 are selectively assigned to the client-side electronic musical apparatuses 10. In one example, such selective assignment may be made such that a specific one of the client-side electronic musical apparatuses 10 is disabled from using the function of the sequencer module BL14 of the server-side electronic musical apparatus 30, while another client-side electronic musical apparatus 10 is disabled from using the function of the recorder module BL17 of the server-side electronic musical apparatus 30. In another example, such selective assignment may be made such that a specific one of the client-side electronic musical apparatuses 10 is allowed to use only the music data storage/reproduction function of the sequencer module BL14 of the server-side electronic musical apparatus 30, while another electronic musical apparatus 10 is allowed to use only the automatic accompaniment and training functions of the sequencer module BL14 of the server-side electronic musical apparatus 30. In the other example, such selective assignment may be made such that a specific one of the client-side electronic musical apparatuses 10 is given higher priority than the other client-side electronic musical apparatuses 10 in using the functions of the server-side electronic musical apparatus 30 (e.g., in obtaining more music channels), in other words, such that a specific function is preferentially assigned to the specific client-side electronic musical apparatus 10 or specific client-side electronic musical apparatuses 10.

In the above-described embodiment, furthermore, the functions of the client-side electronic musical apparatuses 10 are completely different from those of the server-side electronic musical apparatus 30, however, the above-described embodiment may be modified to provide a specific one of the client-side electronic musical apparatuses 10 with the functions of the server-side electronic musical apparatus 30. More specifically, the specific client-side electronic musical apparatus 10 having the performance operators 11, sound system 14, etc. may be equipped with various functions of the server-side electronic musical apparatus 30, being capable of working as the client-side electronic musical apparatus 10 as well as functioning as the server-side electronic musical apparatus 30 that responds to requests from the other client-side electronic musical apparatuses 10.

In the above-described embodiment, furthermore, the server-side electronic musical apparatus 30 is provided with the functions of the sequencer module BL14, the tone generator module BL15, the mixer module BL16 and the recorder module BL17. The above-described embodiment may be modified to employ a plurality of server-side electronic musical apparatuses 30. In this modification, one or more of the above-described functions is/are contained in each of the server-side electronic musical apparatuses 30 so that the above-described functions are shared by the plurality of server-side electronic musical apparatuses.

Although descriptions about the above-described embodiment do not include power management, the power management of the server-side electronic musical apparatus 30 may be done in accordance with the operational status of the client-side electronic musical apparatuses 10. The power management may be done, for example, such that the server-side electronic musical apparatus 30 is activated in power saving mode, and enters normal operational mode when any one of the client-side electronic musical apparatuses 10 is activated. In this power management, when all the client-side electronic musical apparatuses 10 have completed their operation, the server-side electronic musical apparatus 30 enters power saving mode again.

In the above-described embodiment, furthermore, the sound system 14 is integrally formed in the client-side electronic musical apparatus 10, however, the above-described embodiment may be modified such that the sound system 14 is separately provided on the client-side electronic musical apparatus 10 so that the sound system 14 is selectively connected to the client-side electronic musical apparatus 10. In this modification, the client-side electronic musical apparatus 10 may be selectively connected to both of the amplifier and the speakers that form the sound system 14. Alternatively, the client-side electronic musical apparatus 10 may be equipped with the amplifier and selectively connected only to the speakers.

What is claimed is:

1. An electronic musical apparatus system in which a plurality of client-side electronic musical apparatuses are connected to a server-side electronic musical apparatus through a communications network, wherein each of the plurality of client-side electronic musical apparatuses is provided with identification data for identifying the respective client-side electronic musical apparatuses, and each of the plurality of client-side electronic musical apparatuses comprises:

an operational signal transmitting portion for attaching the provided identification data to an operational signal representative of operation by a user on the client-side electronic musical apparatus, and transmitting the operational signal with the identification data to the server-side electronic musical apparatus; and a data reproducing portion for retrieving, from among musical tone data having identification data transmitted from the server-side electronic musical apparatus in response to the transmission of said operation signals, musical tone data having its own identification data, and generating a musical tone on the basis of the retrieved musical tone data, and wherein the server-side electronic musical apparatus comprises:

a data generating portion for receiving operational signals transmitted from the respective client-side electronic musical apparatuses, and independently and concurrently executing, through the use of identification data attached to the operational signals, processes corresponding to the operational signals for the respective client-side electronic musical apparatuses to generate musical tone data; and a data transmitting portion for attaching to the musical tone data generated by the data generating portion the identification data attached to the operational signals and transmitting the musical data with the identification data to the respective client-side electronic musical apparatuses, wherein each of the plurality of client-side electronic musical apparatuses further includes performance operators for playing a musical instrument and setting operators for specifying a mode of musical tones, wherein said operational signals include MIDI event data representative of operation of said performance operators and an operation event signal representative of operation of said setting operators, wherein said data generating portion comprises a tone generator module, wherein the processes executed by said data generating portion includes generation, by said tone generator module, of tone signal as musical tone data, and wherein said tone signals is specified by said MIDI event data following a parameter set by said operational event signal representative of operation of said setting operators.

2. An electronic musical apparatus system according to claim 1, wherein each of the plurality of client-side electronic musical apparatuses further comprises a connection request transmitting portion for transmitting a connection request along with the provided identification data to the server-side electronic musical apparatus, and the server-side electronic musical apparatus further comprises a screen data transmitting portion for transmitting to the client-side electronic musical apparatus, in response to the connection request, screen data to which the identification data transmitted along with the connection request is added;

whereby the data reproducing portion of the respective client-side electronic musical apparatuses retrieves, from among screen data having identification data transmitted from the server-side electronic musical apparatus in response to the connection request, screen data having its own identification data and displays a screen on the basis of the retrieved screen data.

3. An electronic musical apparatus system according to claim 1, wherein the generator module is formed of a plurality of tone generator channels for generating musical tone signals.

4. An electronic musical apparatus system according to claim 1, wherein the data generating portion of the server-side electronic musical apparatus has a sequencer module responding to each of the plurality of the client-side electronic musical apparatuses in an independent manner to generate data representative of a musical tone or a musical score on the basis of previously stored music data.

5. An electronic musical apparatus system according to claim 1, wherein the data generating portion of the server-side electronic musical apparatus has a mixer module comprising a plurality of input buses each corresponding to each of the plurality of client-side electronic musical apparatuses, a plurality of output buses each corresponding to each of the plurality of client-side electronic musical apparatuses, and a plurality of mixing buses provided between each of the input buses and each of the output buses to selectively output, to the output buses, digital signals input to the input buses.

6. An electronic musical apparatus system according to claim 1, wherein the data generating portion of the server-side electronic musical apparatus has a recorder module for recording and reproducing a digital musical tone signal in corresponding relation to each of the plurality of client-side electronic musical apparatuses.

7. An electronic musical apparatus system according to claim 1, wherein the data generating portion of the server-side electronic musical apparatus has a screen data generating module for generating screen data for a function of a plurality of functions that corresponds to the received operational signal and screen data applicable to the plurality of functions in common.

8. An electronic musical apparatus system according to claim 1, wherein the data generating portion of the server-side electronic musical apparatus achieves a plurality of functions, the plurality of functions being selectively assigned to the plurality of client-side electronic musical apparatuses.

9. An electronic musical apparatus system according to claim 1, wherein the data generating portion of the server-side electronic musical apparatus achieves a predetermined function, the function being preferentially assigned to a specific one of the client-side electronic musical apparatuses.

10. A server-side electronic musical apparatus connected with a plurality of client-side electronic musical apparatuses through a communications network, the server-side electronic musical apparatus comprising:

a data generating portion for receiving operational signals which are transmitted from the respective client-side electronic musical apparatuses and to which identification data for identifying the respective client-side electronic musical apparatuses are attached, and independently and concurrently executing, through the use of the identification data attached to the operational signals, processes corresponding to the operational signals for the respective client-side electronic musical apparatuses to generate musical tone data or display data; and a data transmitting portion for attaching to the musical tone data generated by the data generating portion the identification data attached to the operational signals and transmitting the musical data with the identification data to the respective client-side electronic musical apparatuses, wherein said operational signals include MIDI event data representative of operation of performance operators of said client-side electronic musical apparatuses and an operational event signal representative of operation of setting operators of said client-side electronic musical apparatuses, wherein said data generating portion includes a tone generator module, wherein said processes executed by said data generating portion include generation, by said tone generator module, of tone signals as said musical tone data, and wherein tone signals being specified by said MIDI event data following a parameter set by said operational event signal representative of operation of said setting operators.

11. A client-side electronic musical apparatus connected with a server-side electronic musical apparatus through a communications network, the client-side electronic musical apparatus comprising:

an operational signal transmitting portion for attaching identification data for identifying the client-side electronic musical apparatus to an operational signal representative of operation by a user on the client-side electronic musical apparatus, and transmitting the operational signal with the identification data to the server-side electronic musical apparatus;

a data reproducing portion for retrieving, from among musical tone data having identification data transmitted from the server-side electronic musical apparatus in response to the transmission of operational signal, musical tone data having its own identification data, and generating a musical tone signal on the basis of the retrieved musical tone data;

a plurality of performance operators for playing a musical instrument; and setting operators for specifying a mode of musical tones, wherein said operational signals include MIDI event data representative of operation of said performance operators and an operational event signal representative of operation of said setting operators.

12. A computer-readable medium encoded with a computer program applied to a server-side electronic musical apparatus connected with a plurality of client-side electronic musical apparatuses through a communications network, the computer program causing the server-side electronic musical apparatus to perform the steps of:

a data generating step for receiving operational signals which are transmitted from the respective client-side electronic musical apparatuses and to which identification data for identifying the respective client-side electronic musical apparatuses are attached, and independently and concurrently executing, through the use of the identification data attached to the operational signals, processes corresponding to the operational signal for the respective client-side electronic musical apparatuses to generate musical tone data; and a data transmitting step for attaching to the musical tone data generated by the data generating step the identification data attached to the operational signals, and transmitting the musical data with the identification data to the respective client-side electronic musical apparatuses, wherein said operational signals include MIDI event data representative of operation of performance operators of said client-side electronic musical apparatuses and an operational event signal representative of operation of setting operators of said client-side electronic musical apparatuses, wherein said data generating step includes a step of generating tone signals as said musical tone data, and wherein said tone signals is specified by said MIDI event data following a parameter set by said operational event signal representative of operation of said setting operators.

13. A computer-readable medium encoded with a computer program applied to a client-side electronic musical apparatus connected with a server-side electronic musical apparatus through a communications network, the computer program causing the client-side electronic musical apparatus to perform the steps of:

an operational signal transmitting step for attaching identification data for identifying the client-side electronic musical apparatus to an operational signal representative of operation by a user on the client-side electronic musical apparatus, and transmitting the operational signal with the identification data to the server-side electronic musical apparatus; and a data reproducing step for retrieving, from among musical tone data having identification data transmitted from the server-side electronic musical apparatus in response to the transmission of operational signal, musical tone data having its own identification data, and generating a musical tone signal on the basis of the retrieved musical tone data, wherein said operational signals include MIDI event data representative of operation of performance operators of said client-side electronic musical apparatus and an operational event signal representative of operation of setting operators of said client-side electronic musical apparatus.

* * * * *